United States Patent [19]

Nicholson

[11] 4,294,177

[45] Oct. 13, 1981

[54] SUPPORT BRACKET AND OPEN SHELVING ASSEMBLY

[76] Inventor: James A. Nicholson, 10600 Van Stralen Way, Rancho Cordova, Calif. 95670

[21] Appl. No.: 851,299

[22] Filed: Nov. 14, 1977

[51] Int. Cl.[3] ..... A47B 37/00

[52] U.S. Cl. ..... 108/42; 108/111; 108/161; 312/257 SK

[58] Field of Search ..... 108/42, 44, 47, 48, 108/59, 92, 106, 111; 126/333, 332; 52/36; 211/107; 312/198, 257 SK

[56] References Cited

U.S. PATENT DOCUMENTS

| | | | |
|---|---|---|---|
| 205,852 | 7/1878 | Furst et al. | 52/36 |
| 313,940 | 3/1885 | Kehoe | 126/333 |
| 1,566,551 | 12/1925 | Ghrand | 211/118 X |
| 2,122,489 | 7/1938 | Pickup | 126/333 |
| 2,289,523 | 7/1942 | Smallen | 126/333 X |
| 2,321,916 | 6/1943 | Ingerman | 182/82 X |
| 2,527,253 | 10/1950 | Hedfield | 248/239 |
| 3,120,199 | 2/1964 | Kolster et al. | 108/6 |
| 3,178,244 | 4/1965 | Reiss et al. | 312/245 X |
| 3,256,053 | 6/1966 | Levenberg | 312/245 X |
| 3,538,842 | 11/1970 | Labbato | 211/90 X |
| 3,892,452 | 7/1975 | Williams et al. | 312/198 X |
| 4,111,502 | 9/1978 | Kessler | 312/245 X |

FOREIGN PATENT DOCUMENTS

| | | | |
|---|---|---|---|
| 1314786 | 12/1962 | France | 312/245 |
| 50297 | 4/1941 | Netherlands | 248/603 |
| 345774 | 11/1931 | United Kingdom | 108/108 |
| 1035255 | 7/1966 | United Kingdom | 211/88 |

*Primary Examiner*—James T. McCall

[57] ABSTRACT

What is disclosed herein is a constructive set of methods that are ecologically tuned to use and provide, inexpensively, more extensive utilization of cabinets already installed in most living modes and accommodations. By utilizing a bracket supportive procedure and constructed from channel structured material in right angles or the like and using a plurality of translucent elongated and vertically spaced shelves in combination with a typically or such constructed stove hood, exhaust pipe, and previously installed cabinets far greater use of the kitchen area will be realized. Upon utilization of my invention and at a mere fraction of the cost of new cabinets, the kitchen decor will be substantially enhanced. The utility in the kitchen will be more practical and approximately nine square feet of counter space will be realized plus; approximately fifteen cubic feet of cabinet space at the working level.

5 Claims, 8 Drawing Figures

SUPPORT BRACKET AND OPEN SHELVING ASSEMBLY

CROSS REFERENCES

| | | |
|---|---|---|
| 373,002 | 1887 | F. Aldrich |
| 1,463,242 | 1923 | B. Biggs |
| 2,275,772 | 1942 | L. J. Koch |
| 2,392,038 | 1946 | A. K. Gaylord |
| 2,535,707 | 1950 | E. E. Vezey, Jr. |
| 3,799,072 | 1974 | J. K. Slaboden |
| 3,993,002 | 1976 | A. L. Stroh |

SUMMARY OF INVENTION

Primarily the invention relates to a support bracket and open shelving assembly in combination with a wall cabinet, a back wall and a ceiling also, a ventilator hood and a standing exhaust pipe. For older homes, the support bracket and open shelving assembly will allow a consumer to remove and relocate certain kitchen cabinets thereby realizing the following objectives. The removal of the cabinet supporting the exhaust hood would remove a potential fire support hazard since cabinets in such placement tend to accumulate grease and other items accumulating grease in prolonged storage. Similarly the cabinet which is normally placed above a refrigerator can be removed for easier access whereby in combination these cabinets could be counter topped for additional working surface providing easier access and greater utility at the average working level for most people. The use of this invention will provide easier access for cleaning the fire supportive exhaust pipe and, at the same time, freeing a damper that may be stuck in the open position from accumulations of grease which will save money on heating the home. For newly designed homes, this unique invention will provide a beautiful addition to a kitchen scheme.

Generally the invention consists of a substantially right angle bracket consisting of a elongated first bracket in engagement with a similar bracket to form a primary bracket with said bracket having cabinet and back wall attachment means, two vertical posts in attachment with said first bracket and vertically spaced apart with each said post having ceiling attachment means. Also, there are a plurality of shelf supports wherein a set is attached to said vertical posts and another set is attachable to the back wall. A plurality of noise dampener devices including a plurality of chatter pads for attachment with said shelf brackets and a plurality of substantially rectangular shelves preferable to the transparent type.

VIEWS OF INVENTION

DETAILED DESCRIPTION OF INVENTION

The support bracket and open shelving assembly can be fabricated from poly-plastics, synthetic rubber products and with metals by using molding principles. Also, for attachment of parts, welding, dry wall screw devices and wood screws can be used. The stamp machine principles can be used for some shelf supports. For shelving it is preferred that transparent material be used. Wood products can be used for many of the parts of the invention. However, it is preferred that nonfire supportive material be used for fabrication.

Figure 1:
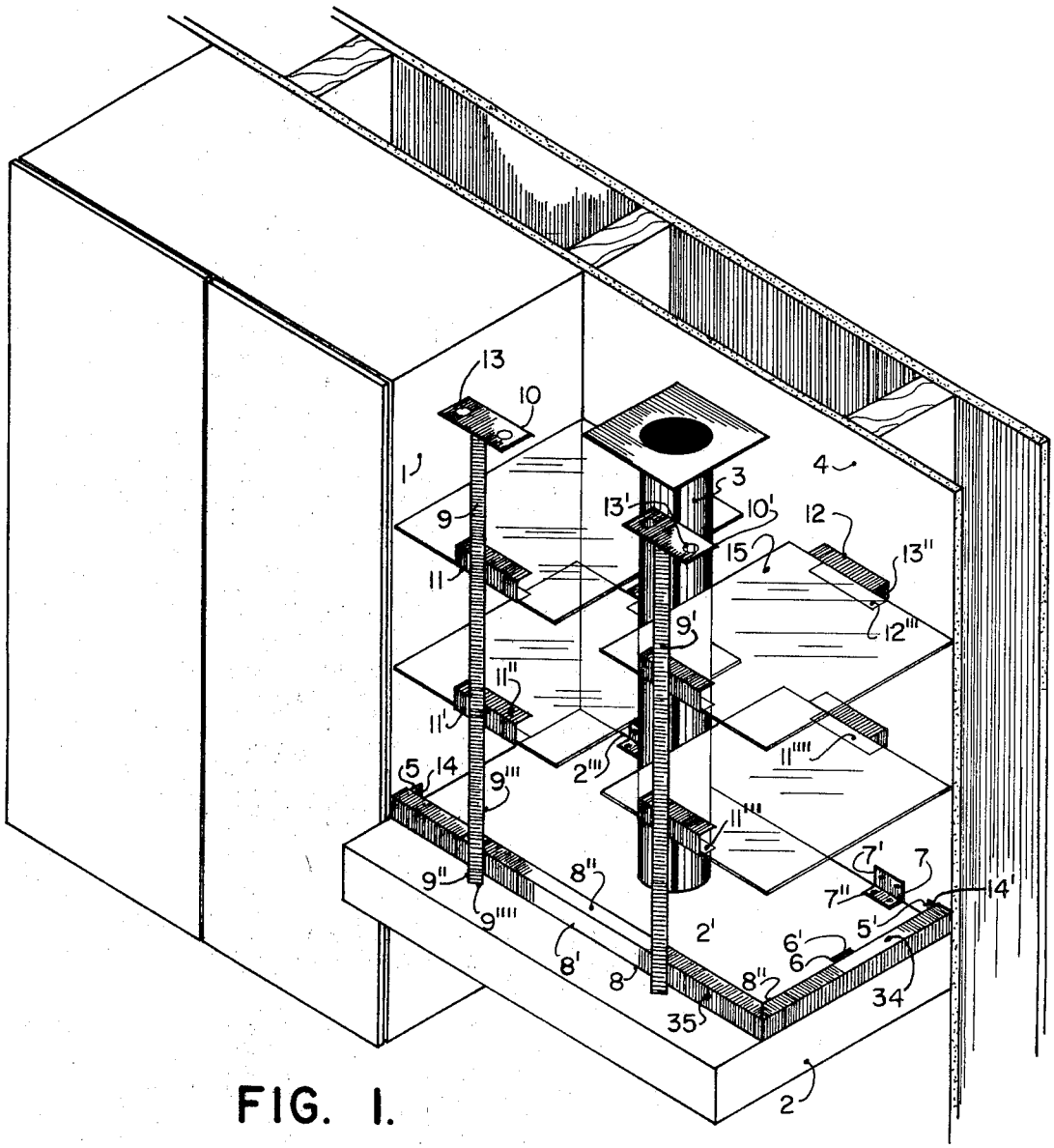
FIG. 1 is a frontal combination of the disclosure.
Figure 2:
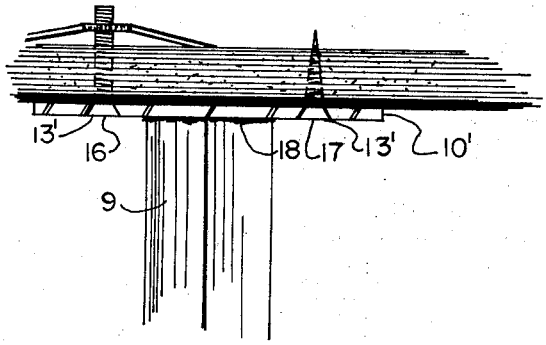
FIG. 2 is a frontal fragment of the ceiling anchor plate in attachment.
Figure 3:
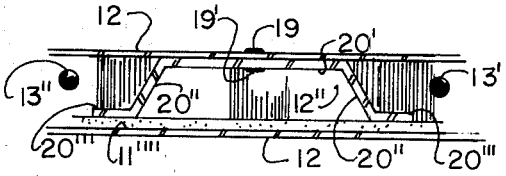
FIG. 3 is a frontal fragment of a shelf support with inner components.
Figure 4:
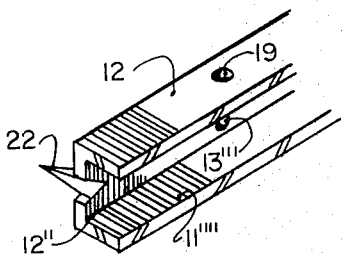
FIG. 4 is a frontal fragment of an alternate shelf support.
Figure 5:
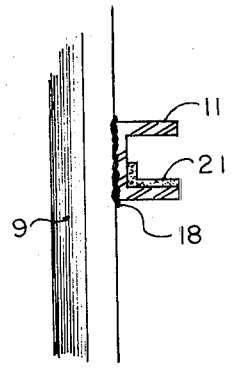
FIG. 5 is a side embodiment of a vertical post with attachments.
Figure 6:
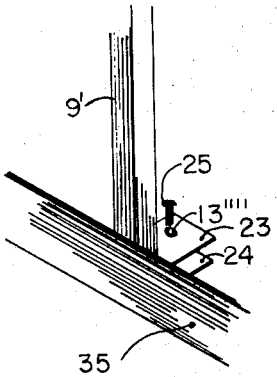
FIG. 6 is a angled side embodiment of an alternate mode of attaching vertical posts.
Figure 7:
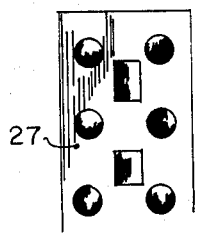
FIG. 7 is a preferred design for use on all brackets of disclosure.
Figure 8:
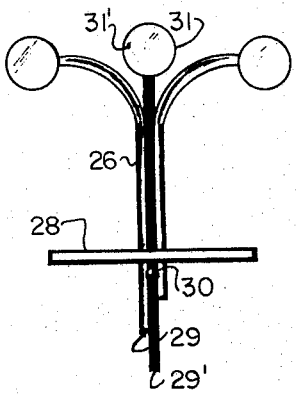
FIG. 8 is a frontal alternate embodiment of a shelf support.

The support bracket and open shelving assembly is designed for use in combination with a wall cabinet 1, a back wall 4 and a ceiling 36. Also, a ventilator hood 2 and a standing exhaust pipe 3; wherein said assembly (FIG. 1) focuses on the standing exhaust pipe thereby enhancing the combination of all other parts of the disclosure. The said assembly comprises the following parts, a support bracket to support the ventilator hood 2 wherein said bracket consist of an elongated first bracket 8 with said bracket having a rectangular flat facing surface 8' and extending from each side of said facing surface an upper 8'' and lower base 8''' extensions with said extensions opposingly spaced apart and in the same elongation as said first bracket 8. A second bracket 34 having the same facing surface 8', upper 8'' and lower base 8''' extensions, but not the same elongation as said first bracket. Both said brackets are attached at right angles with their extensions facing inwardly of said flat facing surface thereat forming a primary bracket 35 for said assembly. The ventilator hood 2 may be attached to the said primary bracket's lower base 8''' extension. Three tubular extensions are provided with two of said tabs 6 attached to the leading edge of said base 8''' extension and with said tabs extending beyond said base extention and with the third said tab 6 similarly attached to the base 8''' extension of said second bracket of said primary bracket 35. Each said tab is provided with a circular aperture 6' for attaching the said ventilator hood's top surface 2' to the transverse side of said tabular extensions of said primary bracket 35. Also, to attach the primary bracket to the cabinet side wall 1' and the same bracket to a room back wall 4, two tabs 5-5' are provided. Each of the tabs should not exceed the transverse side of said facing surface 8' between the upper 8'' and base 8''' extensions of the primary bracket 35 in that way tab 5 can be slipped in-between said extensions and abut with the transverse side of said facing surface 8' at the end of the first bracket 8. It is felt that this manner of attachment will add lateral strength to the said primary bracket and at the same time provide a smooth outer facing 8' when said primary bracket 35 is in attachment with the side wall 1' of said cabinet. Tab 5' is similarly attached to the second bracket end and both said tabs 5-5' are at right angles in attachment with said primary bracket and extend beyond said extensions of said primary bracket sufficiently to provide for apertures 14—14' within each of said tabs 5-5'. Realizing that the ventilator hood 2 may not be stable rearwardly, two stabilizer anchors 7-7' are provided with each said stabilizer consisting of a vertical rectangular plate 7'' in attachment with a horizontal rectangular base plate 7''' to form a basic right angle facing anchor plate with the vertical and horizontal plates equal in size. Each said plate is provided with a central circular aperture 13. The stabilizer anchors 7-7' are spaced apart equally in regards to the rearward length 2'' of said ventilator hood 2 and the vertical plates 7'' of each said stabilizer anchors 7-7' are attached to the aforesaid back wall 4 with the horizontal plates 7''' extending outward from said back wall thereat said horizontal plates are attached to the surface 2' of said ventilator hood. The ventilator hood 2 is completely secured to said primary bracket 35. So that the aforedescribed primary bracket may have vertical support and stabilization, two basically square (FIG. 1) and elongated posts 9-9' are provided with said posts in attachment vertically and spaced apart on and to the flat facing surface 8' of said elongated first bracket 8 of said primary bracket with one end 9'' of each said posts in horizontal alignment with said elongated first brackets 8. Each said vertical posts 9-9' is preferably in attachment by one corner 9''' of the basically square vertical posts 9-9' for it is felt that that manner of attachment will add beauty to the assembly. The spaced apart relationship of the vertical posts 9-9' should be equal on each side of the exsisting standing exhaust pipe 3 thereby maximizing the exposure of said pipe. With equal balance of said parts we provide for the utilization of equally sized shelving for said disclosure. To complete the aforesaid vertical support, etc., for said primary bracket two ceiling attachable plates 10-10' are provided for attachment to the tops of said vertical posts 9-9' with each said plate consisting of a flat rectangular plate with one side in attachment with each of said vertical posts with said plates in the horizontal position and central of said plate whereby each plate extends beyond said vertical posts horizontally. Each said plate 10-10' is provided with two spaced apart apertures 13' adjacent to the vertical posts. The plates through the apertures 13' are to the existing ceiling 36 of the combination of the disclosure using preferably dry wall attaching devices 16 and/or where the case admits common wood type screws 17 (FIG. 2). With the vertical support and stabilization of the primary bracket, heretofore described, a plurality of shelf supports 11-12 are provided in sets of four wherein one set of shelf supports 11 are attached horizontally and spaced apart vertically to the vertical posts 9-9' (FIG. 5) and the second set of shelf supports 12 are attached to the back wall (FIG. 1) in opposed relationship to the first said set. Each of said plurality of shelf supports 11-12 are substantially of the same structure therefore one of said shelf supports 11 consist of a flat rectangular extended top side 11' with said top side having a flat rectangular upper 11'' and lower 11''' extensions therefrom said top side with said extensions in the same elongation as said top side and with said extensions 11''-11''' spaced apart opposingly the same width as the said top side 11' thereof forming a basic shelf support bracket 11. In that basic structure the lower extension 11''' of said shelf support bracket provides the shelving support platform 11'''' for both said sets of said shelf support brackets 11-12. Also, centrally of each said upper extension 11'' of both said sets of shelf support brackets 11-12, a circular aperture 19 is provided in said extension for the purpose of securing noise reducing components. Since with any assembly having a motor device therewith there is a tendency for some vibration from said motor installed normally in the ventilator hood 2 which constitutes one part of this combination disclosure. The vibration does not damage and/or effect the operation of the disclosure however, it does set up a noise annoyance which would not be suitable for some consumers therefore the above noise reducing components. In order to substantially reduce that annoyance, a plurality of noise dampener devices 20 are provided for all of the above described shelf support brackets 11-12 wherein each of the said devices (FIG. 3) consist of a horizontal rectangular strip 20' with said strip not to exceed the width of the upper 11'' extension of the said shelf support brackets. The strip 20' is provided with an aperture 19' centrally of said strip 20' for alignment and attachment to the aperture 19 of said upper 11'' extensions transverse side 12''. Also extending from the ends of said strip 20' are two downwardly extended and diagonally opposed strips 20'' with each said diagonal strip having a horizontally facing foot strip 20''' whereat said foot strip rest on the shelving support platform 11'''' of each said shelf support brackets 11-12. A common rivet (FIG. 3) is used to secure the plurality of dampener devices 20 to the plurality of shelf support brackets 11-12. A plurality of chatter pads 21 are also provided to reduce the annoyance of noise from side chatter when shelving is in position (FIGS. 3–5). Each of said plurality of chatter pads consist of simply a pliable rectangular pad 21' with one side of said pad coated with a self adherent adhesive (not shown). The pad should not exceed in size the upper 11'' and lower 12''' extensions of said shelf support brackets 11-12 thereby the said pad 21' may be attached adhesively to each shelving support platform 11'''' and partially to the transverse side 12'' (FIG. 5) of all said shelf support brackets 11-12. The exception as to the structure of said shelf support brackets is that the back wall 4 of each said bracket is provided with two circular apertures 13'' which are spaced apart on the extended top side 11' of brackets 11-12 whereby the said brackets are attached to the said back wall 4 using one of the options of (FIG. 2). With all of the above parts of the disclosure in their operable position and particularly with the wall attachable and the vertical post attached shelf support brackets extensions facing each other in horizontal and vertical alignment a plurality of shelves 15 preferably of transparent material are provided with each said shelf substantially rectangular and place within the pheriphery of the primary bracket 35, i.e., the width of each shelf exceed the length between the transverse side 12'' of the opposing shelf support brackets 11-12 and the said shelf should not exceed the length between the second bracket 34 of said primary bracket and closely adjacent to the standing exhaust pipe 3. In the above dimensions the balance and beauty of the assembly (FIG. 1) is maintained. The shelves 15 are slipped onto the shelf support platform 11'''' and on top of said chatter pad 21 with the said foot strips 20''' of said dampener devices 20 on the top of said shelves 15. The foot strips apply pressure to keep said shelves in place and reduce the aforesaid annoyance. The foregoing is primarily the basic principles of the combination disclosure. It was found in my model that by using a apertured design of circles, rectangles and squares in all said brackets as noted in the design 27 (FIG. 7) the beauty of the assembly is greatly enhanced. Further with the high cost of freight and materials it is realized that alternate attachment means are appropriate for the support brackets. One such means of attachment pertains to the aforesaid posts 9-9' (FIG. 1) wherein the means consist of providing a tab extention at the base end 9'''' of each said vertical post 9-9' and preferably with one corner 9''' of said posts facing rearward as with the attached said tabs 23. Also, each said tab extention is provided with an aperture 13'''' through said tabs. Further, to provide attaching means for the above tabs 23 and said posts 9-9' the elongated first bracket 8 upper extension 8'' of said primary bracket 35 is provided with two similar tabs 24 to mate with the aforesaid tabs 23 wherein each said tab 24 is attached to the leading edge of said upper extension and extending beyond said extension with each of said tabs provided with an aperture 13''''' so provided to align with the aperture of said tabs 23. Said tabs are spaced apart on said upper extension to maintain the aforesaid balance between the vertical posts 9-9' and the existing standing exhaust pipe 3. Said tabs 23-24 are attached with a common nut and bolt device 25. This breakdown and attachment mode should reduce space should there be a need for shipment. Another alternate mode which is designed to save material pertains to the back wall attachable shelf support brackets 12 wherein said means consist of taking the basic structure of each said wall attachable brackets flat rectangular top side 12' and machine stamping the transverse side 12'' at both ends of said bracket to effect a stabilizer point 22 extending beyond and rearward of said top side 12' of said bracket. The said stabilizer point allows the use of a single aperture 13''' in said top side and a single dry wall screw device 16 thereby material is saved with this mode. Further, where annoying noise from vibration does not present itself, a plurality of alternate shelf supports are provided wherein each said shelf support 26 consist of a horizontal flat rectangular strip 28 which is in attachment at its rearward side 28' of said strip to three elongated vertical sides 29 of three elongated flat rectangular blade like strips 29' that are joined together by their flat sides to create the aforesaid vertisides in attachment with said horizontal strip also, said vertical sides 29 extend above and below said horizontal strip 28. Below said horizontal strip and adjacent to it a circular aperture 30 is provided there-through said three vertical sides 29 also, downward at the ends of said blade like strips 29' each joined end is offset from each other for decorative purposes only. Upwardly and adjacent to the ends of said vertical sides 29 each said sides is attached to a circular disk 31 with each of said disks having a circular mirror like face 31' with said facings and disks extending forward of said vertical sides thereat the two outside blade like strips 29' of said three vertical sides 29 are curved outward opposingly from the center strip of said three blade like strips 29' in an arch like manner (FIG. 8). In the above manner the mirror like facings can reflect available room lighting from their placement to a back wall 4 within the combination of the disclosure. It is to be noted that common and readily available screw type devices and nut and bolt type devices are shown sparingly (FIGS. 2–6) in the disclosure.

What I claim is:

1. In combination with a wall cabinet, a back wall and a ceiling, a ventilator hood and a standing exhaust pipe; a support bracket and open shelving assembly wherein said assembly consist of an elongated first bracket and a second bracket with both said bracket having upper and lower base extensions and with said extensions opposingly spaced apart on said first and second brackets and, with said brackets in attachment with said upper and lower base extensions of both said brackets facing inwardly of each other to form a right angle facing primary bracket with said bracket having attachment means at each end of said primary bracket and on the lower base extension, also alternate attaching means; two elongated vertical posts in attachment with the said first bracket with said posts substantially square in cross section and in attachment with said first bracket by one corner of said vertical posts in a spaced apart relationship and with each said post having ceiling attaching means at their top ends also, alternate attaching means of said vertical posts to said first bracket; a plurality of shelving support brackets having upper and lower spaced apart extensions comprising two basic sets of brackets, a first set is attachable to the said vertical posts and, a second set which has attachable means to a back wall, two alternate shelf support means; a plurality of dampener devices affixed inwardly of the aforesaid shelf support brackets to include, one alternate mode of shelf support also, a plurality of chatter pads for association with the said dampener devices and said shelf support brackets; a plurality of preferably transparent rectangular shelving in association with said brackets and components within said brackets and, two stabilizer anchorage means.

2. In combination with a wall cabinet, a back wall and ceiling, a ventilator hood and a standing exhaust pipe; a primary bracket as claimed in 1 wherein said bracket consist of an elongated first bracket having a rectangular flat facing surface which has extending from each elongated side of said flat facing surface, an upper and lower base extensions facing rearward of said facing surface and having said extensions spaced opposingly apart and with said extensions in the same elongation as said facing surface, a second similar bracket with said bracket having a facing surface, upper and lower base extensions, but not in the same elongation as said first bracket wherein both said brackets are attached together at one end of each said bracket with the extensions of both said brackets facing inward of said brackets facing surface to form a right angle facing primary bracket thereof said both brackets and at each end of said primary bracket having attaching means in the form of a tab extension wherein said tab is attached inwardly of and between said spaced apart extensions of said brackets with one end of said tab in abutment with the transverse side of the said flat facing surface of the said brackets also, said tabs in attachment extend beyond said extensions of said brackets sufficiently to provide for a circular aperture therein said tabs also, three similar tabs with apertures are attached to the leading edge of the lower base extension with said tabs extending outwardly from said extensions wherein two said tabs are attached to the elongated first bracket horizontally spaced apart and the third of said tabs is similarly attached centrally of said second brackets lower base extension of said primary bracket; the alternate attachment means consists of providing two similar tabs as above wherein said tabs are attached to the leading edge of said upper extension of said elongated first bracket with said tabs extending outwardly from and horizontally spaced apart thereon said upper extension of said primary bracket.

3. In combination with a wall cabinet, a back wall and a ceiling, a ventilator hood and a standing exhaust pipe; two elongated vertical posts having attaching means and an alternate attachment means as claimed in 1 wherein each said post consists of a substantially square post with one end of said post in attachment by one of its corners of said post in vertical spaced apart relationship to each other and attached to the flat facing surface of said elongated first bracket of claim 2 with the attached end of said vertical posts in horizontal alignment with the base of said flat facing surface also, upward at the top of said vertical posts each is topped with a horizontal and rectangular shaped ceiling anchor plate with said plate having two spaced apart apertures with each said aperture adjacently outward from the side of each vertical post and the center of said ceiling plates, said alternate means of attachment of said vertical post to said first bracket wherein said means consist of providing a flat tabular extension with said tab attached to the vertical posts at the opposite end from said ceiling anchor plates wherein each vertical post has a tab attached at right angle to said vertical post and extending outwardly from same with one corner of each said post facing in the same outward direction as the said tab of each post thereat, said extension tab of each vertical post is provided with an aperture therein, said aperture being in alignment with said apertures of the upper extensions tabs of said elongated first bracket of said primary bracket.

4. In combination with a wall cabinet, a back wall and a ceiling, a ventilator hood and a standing exhaust pipe; a plurality of shelf support brackets in two basic sets and two alternate shelf support means as claimed in 1 wherein said sets differ only in attachment means to said components therefore, each set has substantially the same construction wherein one said shelf support bracket of said plurality consist of a flat rectangular top side with said side having a upper and lower extensions therefrom said side of said top with said extensions being opposingly spaced apart and with the said extensions side being rectangular in the same width as said top side, central of said upper extensions of all said brackets are provided with a circular aperture therein each said extension, the lower extension of each said bracket provides the shelving support platform between the opposing extensions, the plurality of shelf support brackets are equally divided into two sets with one of said sets provided with two circular and spaced apart apertures within the said top side of said set of shelf support brackets, said alternate means of attachment for the back wall attachable shelf support brackets is machine stamped to provide a stabilizer point at each end of the aforesaid top side of each said bracket with said points extending forward of said top side and opposite to said extension therefrom said top of said brackets thereat, a central aperture is provided therein each said top side of said brackets; another alternate shelf support wherein a plurality of said shelf supports are provided with each said support consisting of a flat rectangular shelf support strip horizontal in alignment and in attachment rearward of said strip to three sides of joined, side by side, vertical elongated flat rectangular strips with said joined strips extending above and below said horizontal strip and adjacent to and below said support strip and central of said joined three sides, a circular aperture is provided through said sides, downward of said aperture at the base of said three sides, each of said three sides are offset with said center strip longer than said side strips, the two outside strips of said three sides are curved opposingly outward from their top and center strip in a arch-like manner and each of said three sides is attached to and facing outward from said sides, a circular disk with each said disk having a circular mirror-like facing.

5. In combination with a wall cabinet, a back wall and a ceiling, a ventilator hood and a standing exhaust pipe; a plurality of dampener devices, chatter pads and shelving, two stabilizers as claimed in 1 wherein said plurality of dampener devices consist of a flat horizontal top strip with said strip having a central aperture so placed to align with the upper aperture of each said upper extension of said shelf support brackets as claimed in 4, said strip does not exceed the width of said brackets upper extensions, extending from each end of said top strip are diagonally extending strips opposed to each other with the ends of said diagonal strips adjacent to lower flat extensions of said support brackets, each said diagonal strip is provided with a horizontally extending foot strip wherein said foot strips are in contact with the lower extensions of said brackets therewith said top strip's aperture is aligned with the transverse side of said upper extensions aperture and attached with a common rivet with said dampener device within the opposingly spaced apart upper and lower extensions of each said shelf support brackets, one chatter pad of said plurality being a flat pliable rectangular member having substantially the same width as the support bracket, a plurality of substantially flat rectangular shelving, preferably transparent, with each said shelf not to exceed the lateral length between the transverse top side of said brackets in their attached and opposed operable positions within the assembly and the elongation of each shelf confined within the primary brackets second bracket and closely adjacent to the exsisting standing exhaust pipe, two stabilizer anchors wherein each said anchor consist of a vertical rectangular extension in attachment with a similar horizontal extension in the form of a right angle and central of each said extension a circular aperture is provided also and a preferred design of apertured circles, squares and rectangles for use with all said brackets.

* * * * *